US007389565B2

(12) United States Patent
Cheng

(10) Patent No.: US 7,389,565 B2
(45) Date of Patent: Jun. 24, 2008

(54) HANDLE ASSEMBLY FOR CORDLESS ROMAN SHADES

(76) Inventor: Li-Ming Cheng, No. 215, Jiouru 1st Rd., Samin District, Kaohsiung City (TW)

( * ) Notice: Subject to any disclaimer, the term of this patent is extended or adjusted under 35 U.S.C. 154(b) by 276 days.

(21) Appl. No.: 11/246,091

(22) Filed: Oct. 11, 2005

(65) Prior Publication Data

US 2007/0079476 A1 Apr. 12, 2007

(51) Int. Cl.
*A45C 3/00* (2006.01)

(52) U.S. Cl. ..... 16/422; 16/429

(58) Field of Classification Search ..... 16/422, 16/446, 427, 429, 406, 438; 160/84.01, 84.04, 160/84.05, 84.06; 24/642, 652–657
See application file for complete search history.

(56) References Cited

U.S. PATENT DOCUMENTS

| | | | | | |
|---|---|---|---|---|---|
| 777,140 | A | * | 12/1904 | Redheffer | 16/429 |
| 1,715,009 | A | * | 5/1929 | Scheif | 16/110.1 |
| 2,211,982 | A | * | 8/1940 | O'Malley | 160/384 |
| 2,280,969 | A | * | 4/1942 | O'Malley | 160/384 |
| 2,537,828 | A | * | 1/1951 | Hoffman | 160/384 |
| D186,711 | S | * | 11/1959 | Weisman | D6/581 |
| 3,087,219 | A | * | 4/1963 | Roberts | 16/428 |
| 3,483,910 | A | * | 12/1969 | Gossling | 16/422 |
| 3,484,910 | A | * | 12/1969 | Gossling | 16/422 |
| 2006/0175023 | A1 | * | 8/2006 | Cheng | 160/170 |
| 2007/0084567 | A1 | * | 4/2007 | Chen | 160/84.05 |

* cited by examiner

*Primary Examiner*—Chuck Y. Mah
(74) *Attorney, Agent, or Firm*—Muncy, Geissler, Olds & Lowe, PLLC

(57) ABSTRACT

A handle assembly for cordless roman shades to be installed on the bottom of a roman shade. It includes a handle, an anchor device and an extension plate. The handle has an ornamental plate and an anchor plate that are coupled together to form a clipping space between them. The handle has an upper end engageable with the anchor device. The extension plate is pivotally coupled on the backside of the anchor plate. When the roman shade is rolling or extending, the handle can be grasped by user's hand to exert a force. The anchor plate is coupled with a bracing bar on the bottom of the roman shade to facilitate control of the rolling and extending of the roman shade. The ornamental plate provides a desired adorning effect to enhance the appealing of the roman shade.

6 Claims, 11 Drawing Sheets

HANDLE ASSEMBLY FOR CORDLESS ROMAN SHADES

FIELD OF THE INVENTION

The present invention relates to a handle assembly for cordless roman shades and particularly to a handle assembly installed on the bottom of a roman shade to control rolling and extension of the roman shade.

BACKGROUND OF THE INVENTION

Window coverings are mainly installed on doors and windows to block sunshine and provide adorning function. In order to meet users's requirements, a wide variety of window coverings are available on the market nowadays, such as blinds, roman shades and the likes. The roman shades can be divided in cord controlled shades that are rolled and extended through a lift cord and a cordless roman shade 10 as shown in FIG. 1. The cordless roman shade 10 mainly includes an upper rail 11 which has an automatic winder 12 coupling with a control cord 121. The bottom of the upper rail 11 is coupled with a fabric shade 13. The fabric shade 13 has a backside coupled with a plurality of bracing bars 14 in an equally spaced manner. Each of the bracing bars 14 has a plurality of rings 15 to be threaded by the control cord 121. The control cord 121 has a bottom end coupled with the bracing bar 14 on the bottom.

When in use for rolling or extending the roman shade 10, first, user's hand grasps the bottom of the fabric shade 13 and pushes upwards. The automatic winder 12 winds the fabric shade 13 upwards through the control cord 121 and other relative elements. To extend the roman shade 10, the hand pulls the bottom of the fabric shade 13 downwards, and the automatic wonder 12 and the related elements mentioned above extend the fabric shade. Thus there is no need to provide a lift cord to control rolling and extending of the shade.

However, the cordless roman shade 10 previously discussed still has problems in practice, notably:

1. The fabric shade 13 is pliable and difficult to be moved by forces. The operations of grasping the bottom of the fabric shade 13 and moving upwards cannot always move the fabric shade 13 upwards as desired. Control of the rolling of the shade is difficult.

2. The bottom of the fabric shade 13 does not have any ornamental articles. The adorning effect of the roman shade 10 can only be provided by the patterns formed on the surface of the fabric shade 13. The total appealing is not desirable. With limited ornamental selections, it cannot motivate purchase desire of consumers.

3. During the rolling process of retracting the fabric shade 13 of the cordless roman shade 10 upwards, if user's height is not sufficient and the fabric shade 13 is lifted to an elevation beyond the reach of the user, user's hand cannot grasp the bottom of the fabric shade 13. Rolling operation becomes difficult.

SUMMARY OF THE INVENTION

The primary object of the present invention is to provide a handle assembly for cordless roman shades that is installed on the bottom of a fabric shade of a cordless roman shade to facilitate rolling operation and also provide an adorning effect.

To achieve the foregoing object, the handle assembly for cordless roman shades of the invention mainly includes a handle, an anchor device and an extension plate. The handle has an ornamental plate and an anchor plate that is coupled together and forms a clipping space between them. The anchor plate has a fastening portion on an upper end. The anchor device includes a hollow shell and a latch means. The shell has an opening to receive the fastening portion. The latch means is located in the shell and can be latched and anchored with the fastening portion. The extension plate has a lower end pivotally coupled on the lower end of the backside of the anchor plate through a pin.

The handle assembly thus formed is installed on the bottom of a roman shade and can achieve the following effects:

1. Rolling and extension of the roman shade is easier: users can exert a force on the handle assembly on the bottom of the roman shade. During rolling or extension of the roman shade, through coupling of the anchor plate and a bracing bar on the bottom of the roman shade, the fabric shade can be moved upwards or downwards effectively. As a result, control of the rolling and extension of the roman shade is easier.

2. Provide excellent ornamental function: the handle assembly is located on the bottom of the roman shade. It may be formed with an adorning profile located on the front side of the roman shade to provide a desired decorating effect. Therefore the roman shade can have versatile styles and is more appealing.

3. Provide more conveniences for users of no sufficient height: the extension plate of the handle assembly can be swiveled about the pin on the backside of the anchor plate, thus users who do not have a sufficient height can grasp the extension plate to roll and extend the shade.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
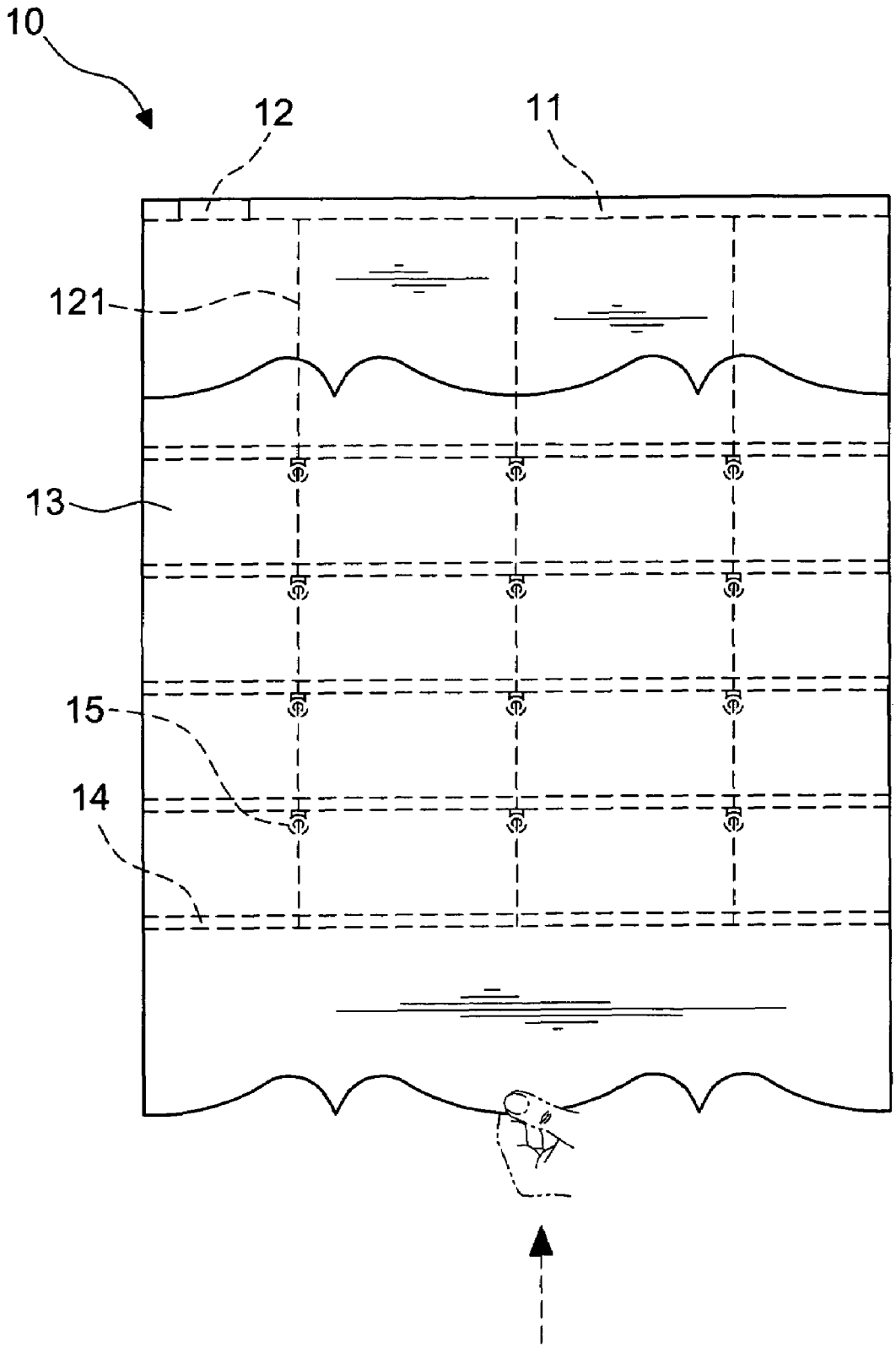
Fig.1 PRIOR ART
FIG. 1 is a schematic view of a conventional cordless roman shade.
Figure 2:
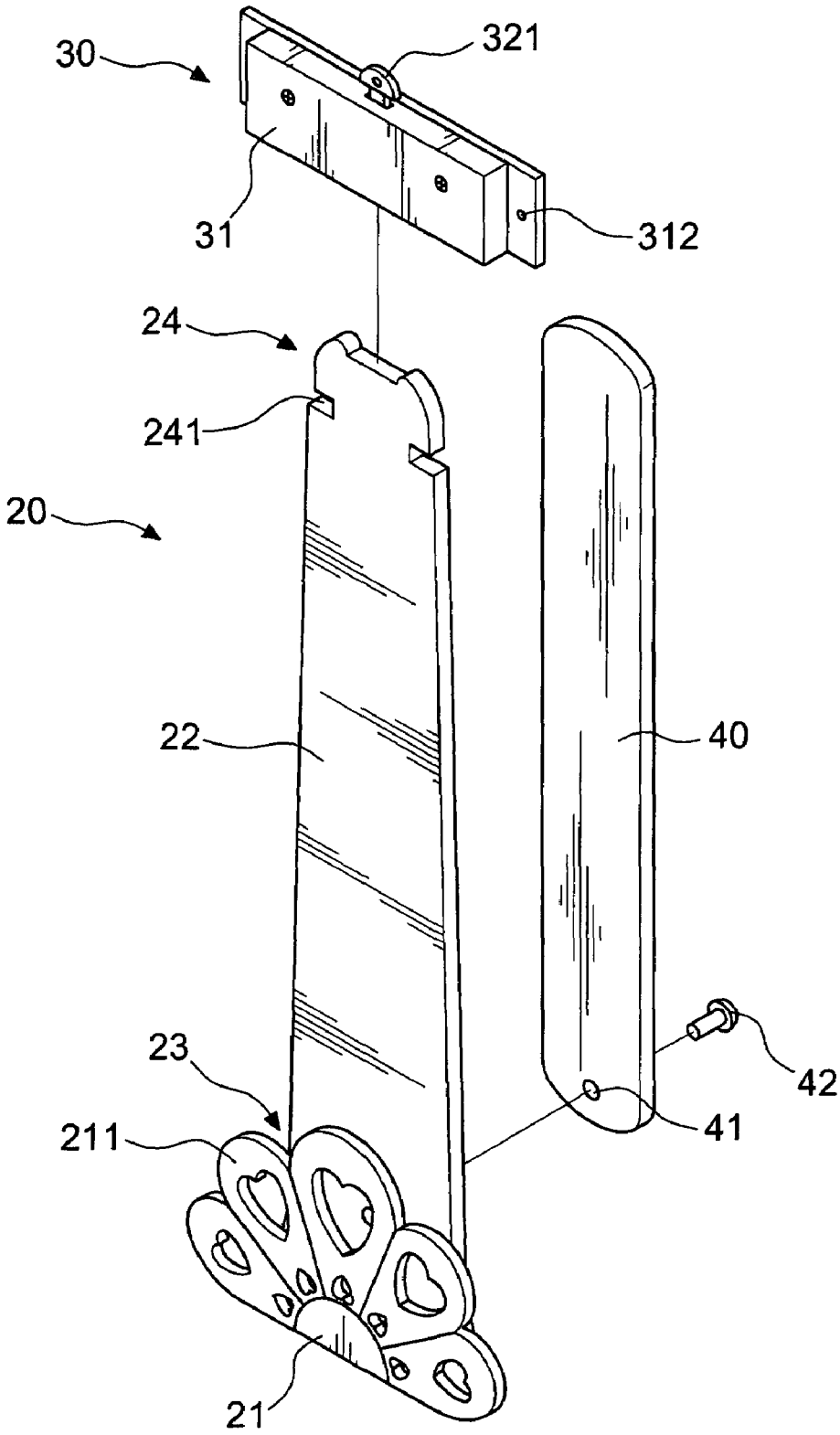
FIG. 2 is an exploded view of the present invention.

Please referring to FIG. 2, the handle assembly for cordless roman shades of the invention includes a handle 20, an anchor device 30 and an extension plate 40. Also referring to FIG. 3, the handle 20 includes an ornamental plate 21 and an anchor plate 22 that are spaced from each other to form a clipping space 23 therebetween, and may be connected on the bottom to become an integrated body, or may be separated from each other but are fastened together through fastening elements such as screws, rivets or the like. The anchor plate 22 has a fastening portion 24 on an upper end. The fastening portion 24 can be fastened to the anchor device 30 through various means and to be disengaged as desired. In an embodiment shown in the drawings, the fastening portion 24 has corresponding notches 241 formed on two opposite sides close to a upper end thereof.

The ornamental plate 21 may be formed in any profile with an adorning effect, such as any desired geometric shapes, floral patterns, animal patterns, or the like. In the embodiment shown in the drawings, the ornamental plate 21 is formed with a plurality of floral petals 211 arranged in a juxtaposed and radial manner.

Figure 4:
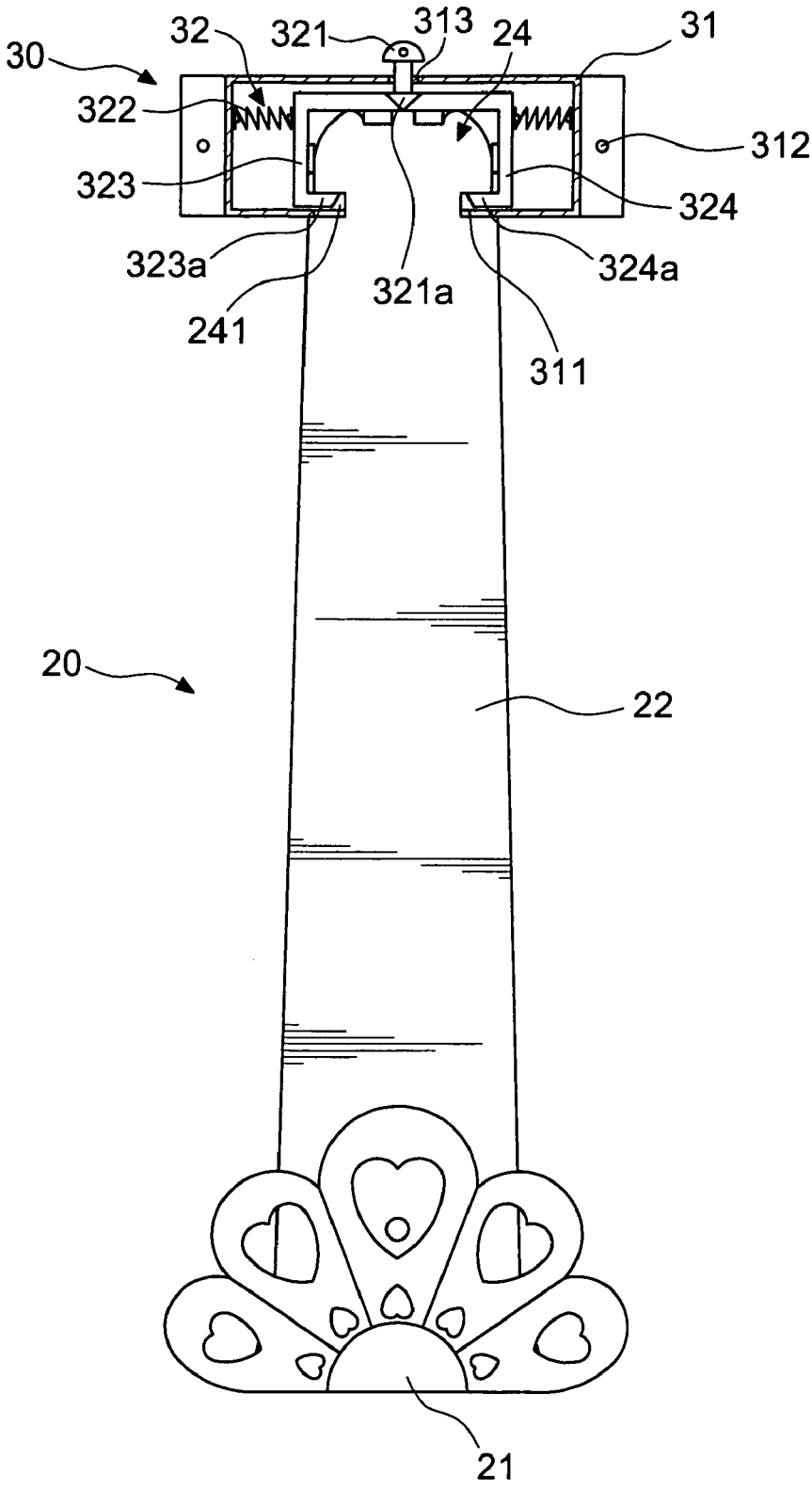
FIG. 4 is a sectional view of the present invention with the handle coupling with the anchor device.

Also referring to FIG. 4, the anchor device 30 includes a hollow shell 31 and a latch means 32. The shell 31 has an opening 311 to receive the fastening portion 24 of the handle 20. The shell 31 further has apertures 312 to receive fastening elements such as screws to engage with screw holes formed on a bracing bar of the roman shade to fasten the shell 31 to the bracing bar. The latch means 32 is located in the shell 31 and can be engaged with the fastening portion 24 inserted into the shell 31. The latch means 32 also allows the handle 20 to be disengaged and removed.

The shell 31 has a hole 313 on a upper end. The latch means 32 includes a pushbutton 321, two springs 322, a first latch strut 323 and a second latch strut 324 movably located in the shell 31. The pushbutton 321 runs through the hole 313 into the shell 31, and has a thrust member 321*a* on one end located in the shell 31. The first and second latch struts 323 and 324 are located on two sides of the thrust member 321*a* in a contact manner, and have latch ends 323*a* and 324*a* corresponding to the notches 241 of the fastening portion 24. The two springs 322 have one end fixedly located in the shell 31 and other end coupled on a middle portion of the first and second latch struts 323 and 324.

Figure 5:
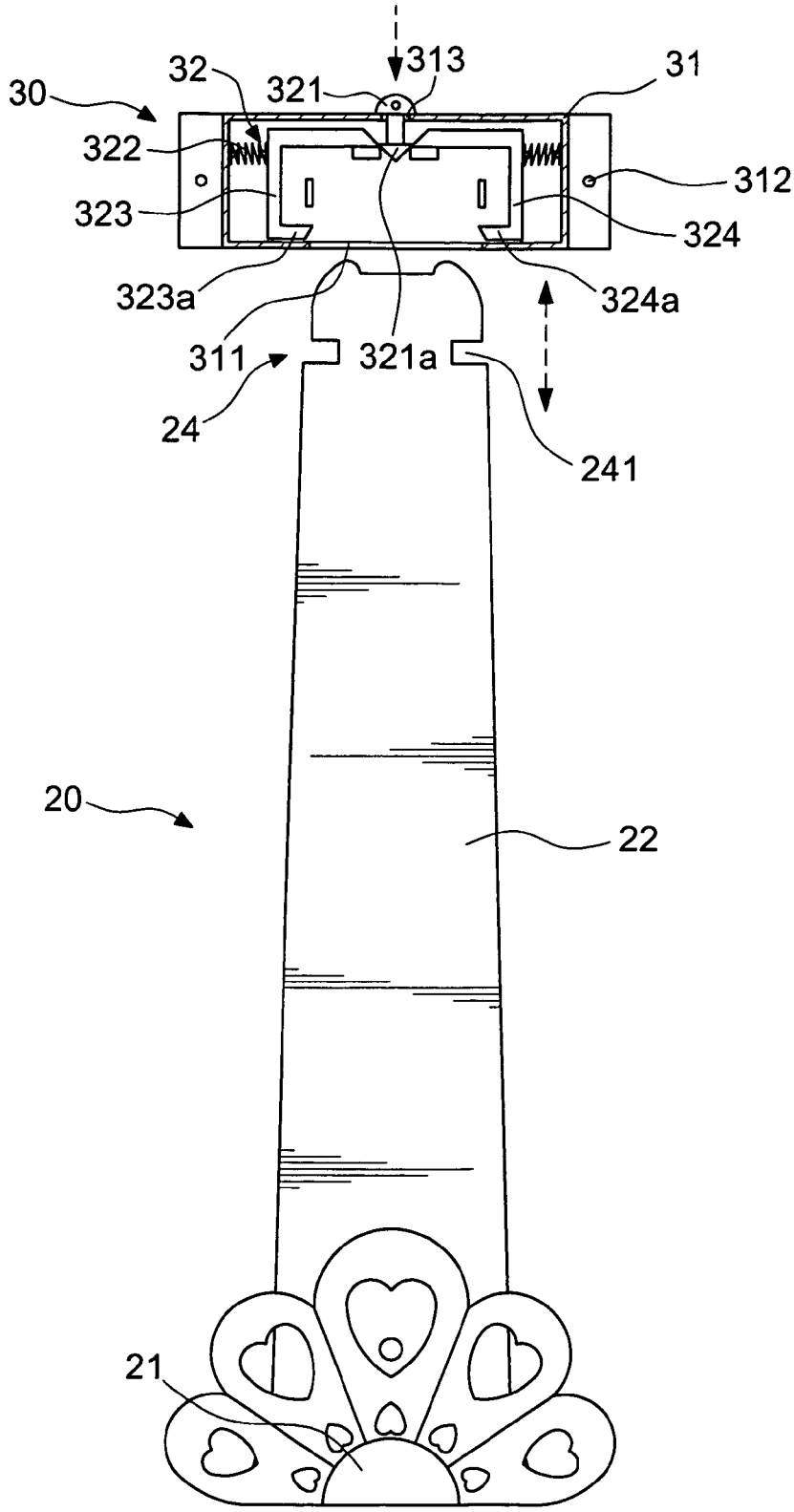
FIG. 5 is a schematic view of the present invention with the handle disengaging with the anchor device.

Referring to FIG. 5, when the pushbutton 321 is depressed, the thrust member 321*a* pushes the first and second latch struts 323 and 324 moving towards the two springs 322 and compressing the springs 322 at the same time; the interval between the latch ends 323*a* and 324*a* increases; thus the fastening portion 24 of the handle 20 can be wedged in between them easily. When the pushbutton 321 is released, the elastic returning force of the springs 322 pushes the latch ends 323*a* and 324*a* to latch in the notches 241 of the fastening portion 24 (as shown in FIG. 4) to form an anchoring condition. When the pushbutton 321 is depressed again, the handle 20 can be removed from the anchor device 30 (as shown in FIG. 5). Hence the handle 20 can be coupled with or removed from the anchor device 30.

Figure 3:
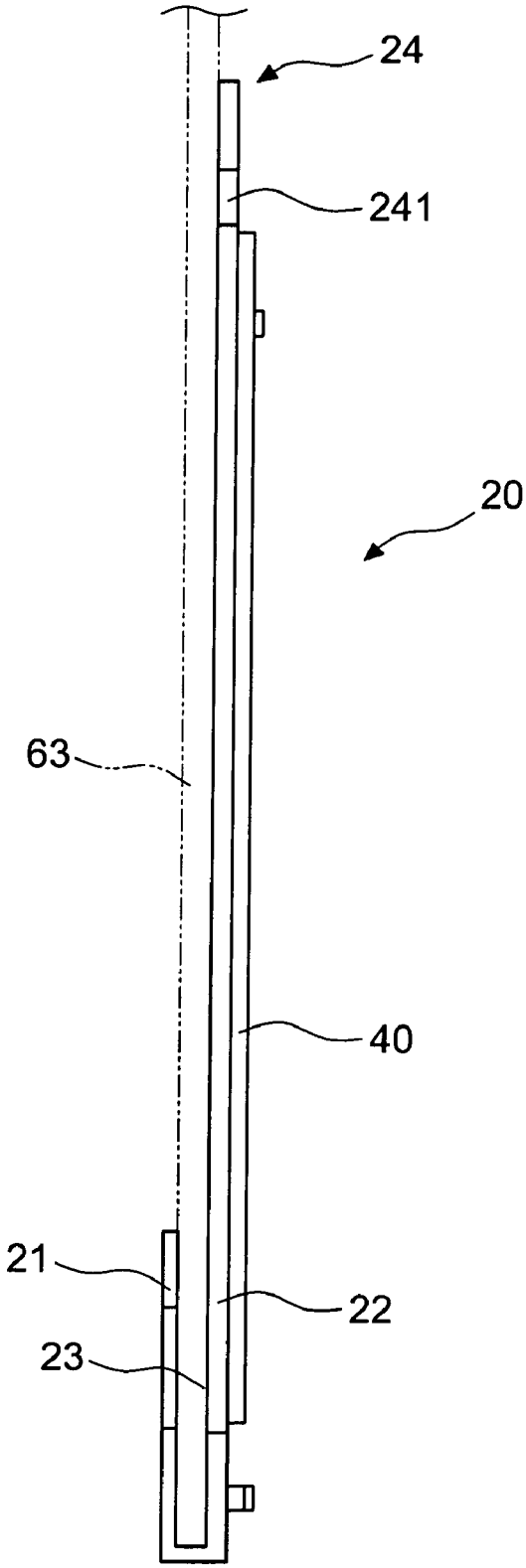
FIG. 3 is a side view of the present invention.
Figure 6:
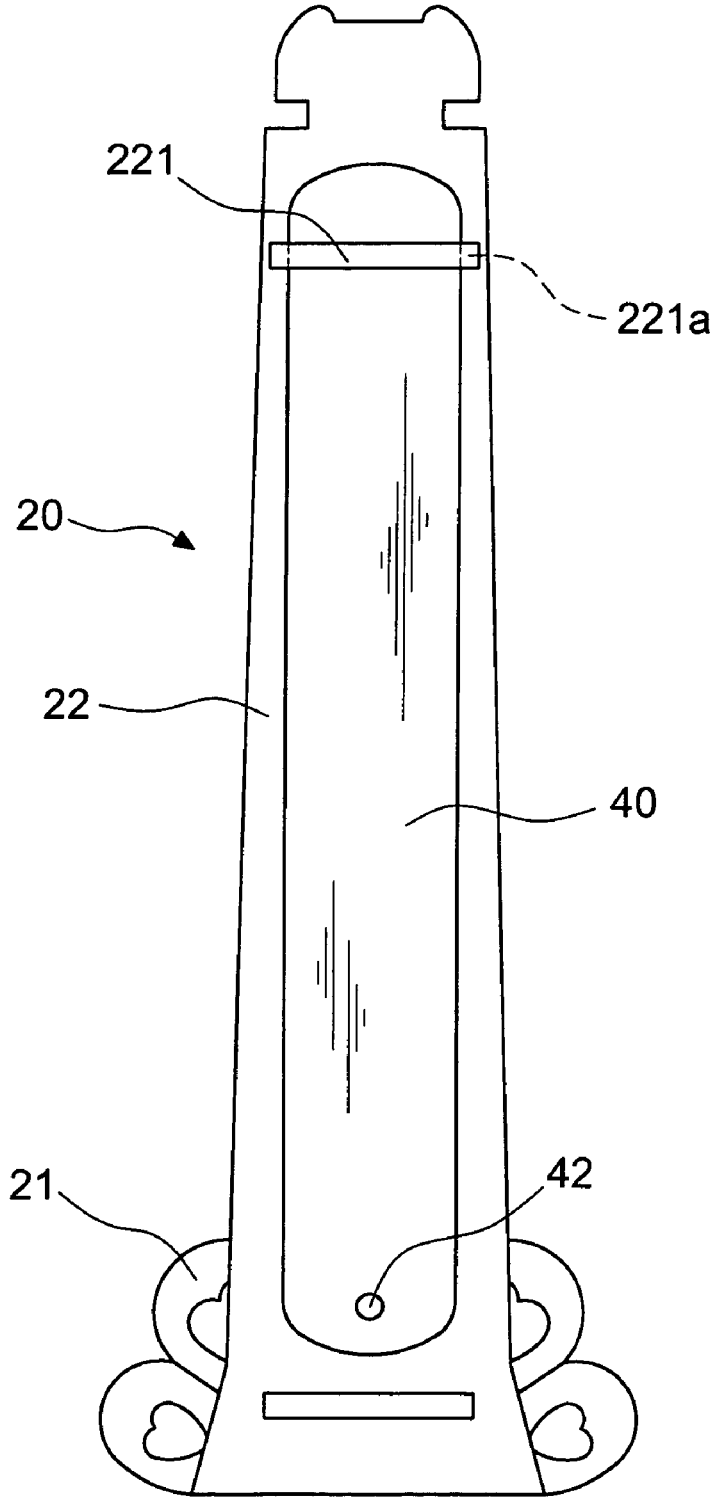
FIG. 6 is a rear view of the present invention.
Figure 7:
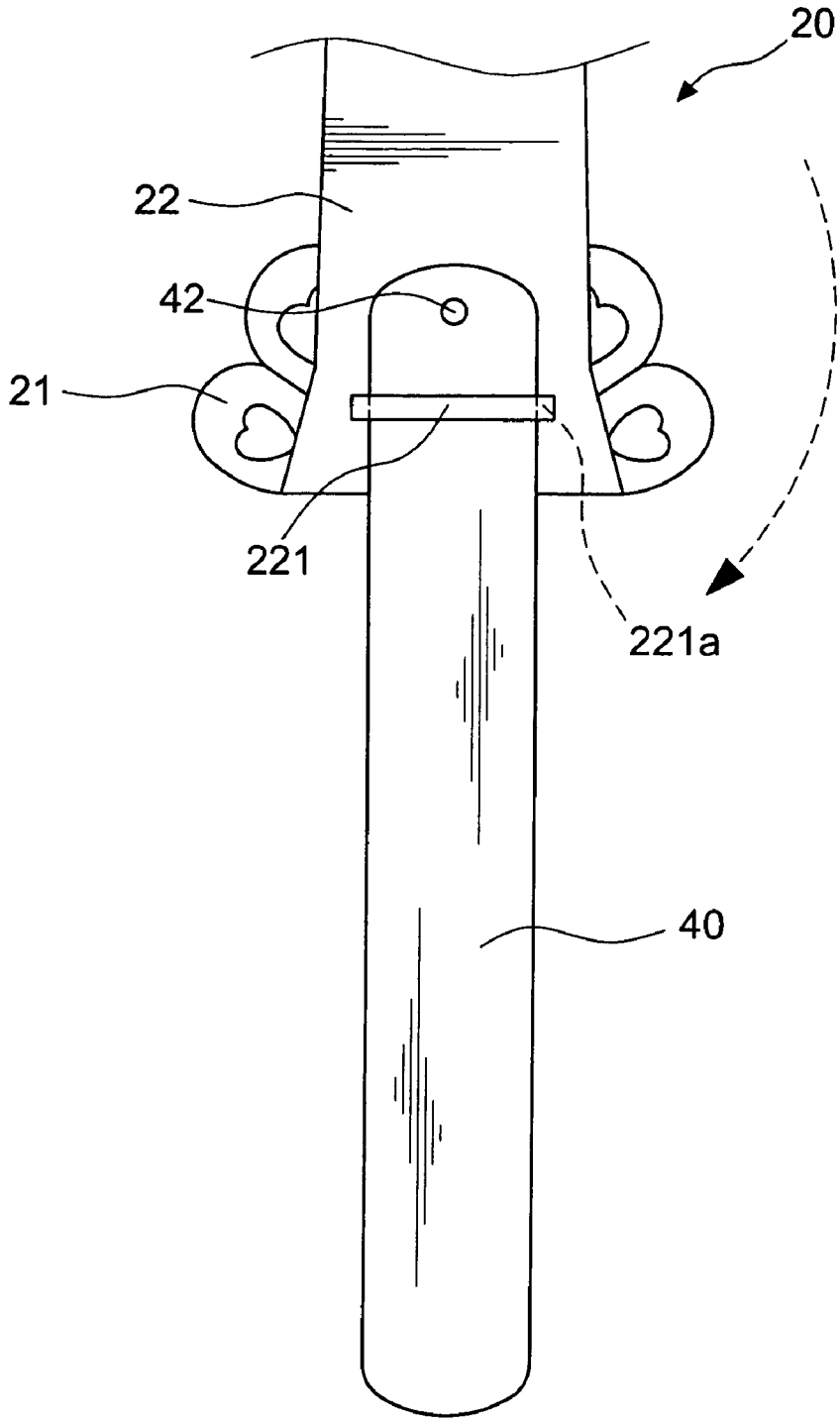
FIG. 7 is a schematic view of the present invention with the extension plate in a swiveling condition.

Referring to FIGS. 2 and 3, the extension plate 40 may be an elongated plate as shown in FIG. 6. It has a pivot hole 41 on a lower end to couple with a lower end of the anchor plate 22 through a pin 42. The anchor plate 22 has a detent member 221 on one side corresponding to the extension plate 40. The detent member 221 has a slot 221*a* on one side. Referring to FIG. 7, the extension plate 40 can be swiveled on the backside of the anchor plate 22 about the pin 42, and latched on an inner side of the detent member 221 through the slot 221*a*.

Figure 8:
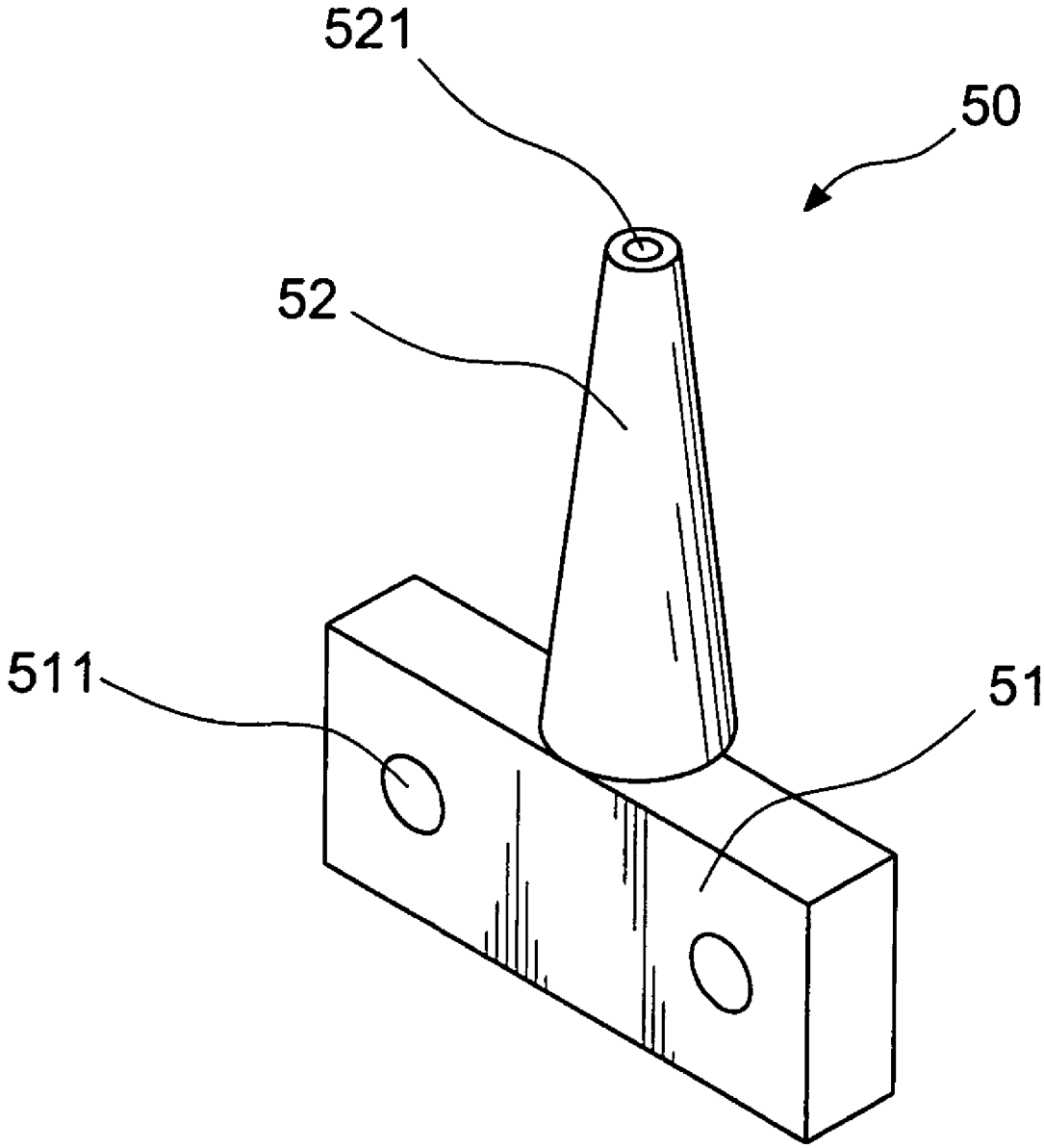
FIG. 8 is a perspective view of an anchor member of the present invention.

Referring to FIG. 8, the handle assembly may further include a plurality of anchor members 50. Each of the anchor members 50 has an anchor plate 51 with an aperture 511 formed thereon. The anchor plate 51 has one side extended to form a conical portion 52 which has a through hole 521.

Figure 9:
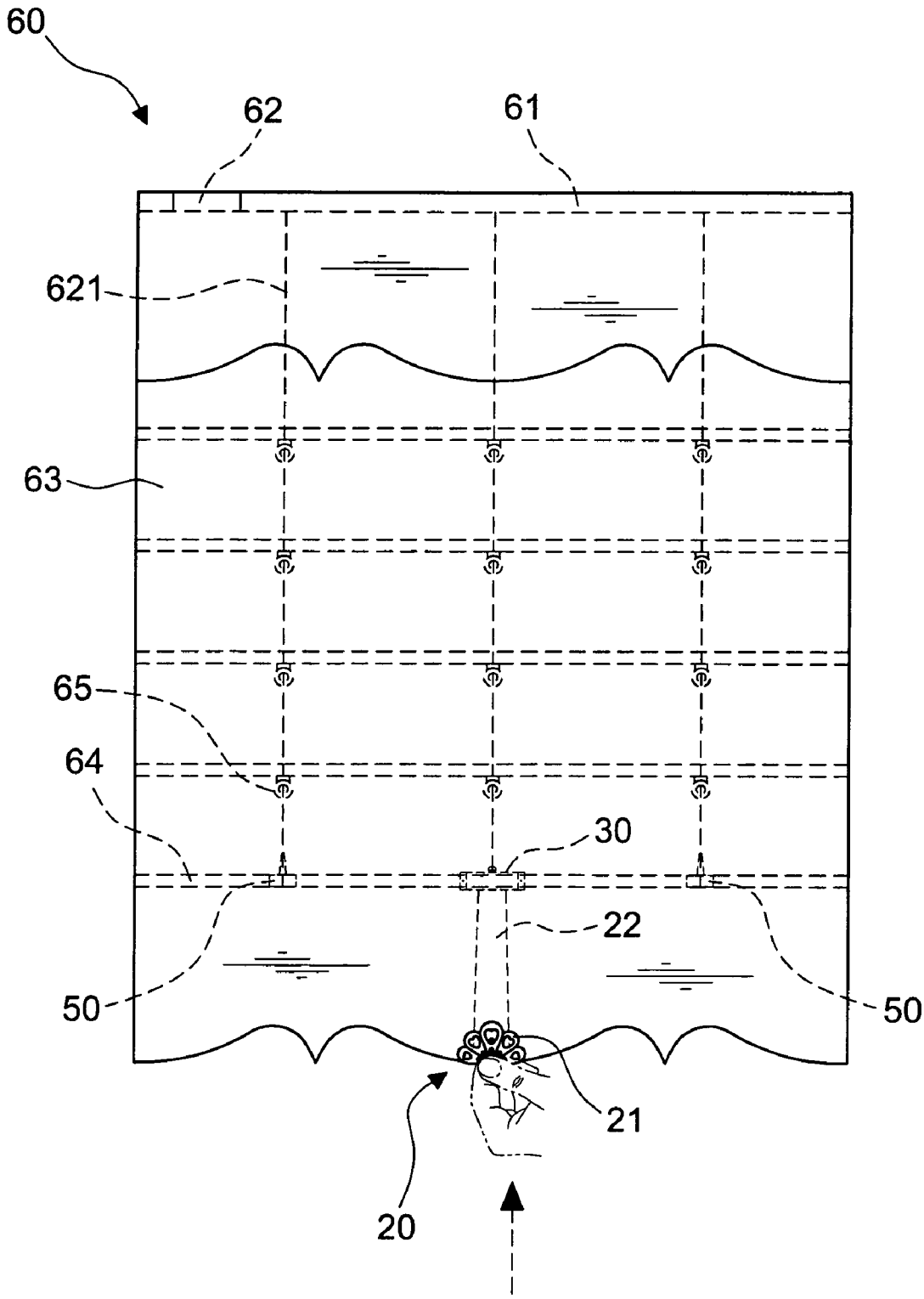
FIG. 9 is a schematic view of the present invention installed on a cordless roman shade.

Referring to FIG. 9 and the drawings depicted before, the handle assembly of the invention is mainly adopted for use on a cordless roman shade 60. The roman shade 60 has a upper rail 61, an automatic winder 62 coupled with a control cord 621, a fabric shade 63, a bracing bar 64 and a ring 65. After assembled for use, referring to FIG. 3, first, place the bottom of the fabric shade 63 in the clipping space 23 of handle 20, with the ornamental plate 21 facing the front side of the roman shade 60; the fabric shade 63 is clipped by the ornamental plate 21 and the anchor plate 22; the length of the anchor plate 22 can be altered according to the distance between the bracing bar 64 on the bottom of the roman shade 60 and the bottom of the fabric shade 63 so that when the handle 20 is installed on the bottom of the roman shade 60, the fastening portion 24 is located on a position corresponding to the bracing bar 64 on the bottom of the roman shade 60; the bracing bar 64 may have a screw hole (not shown in the drawings) corresponding to the aperture 312 of the anchor device 30 so that the anchor device 30 can be fastened to the bracing bar 64 through a fastening element. Thereby the fastening portion 24 can be inserted into the anchor device 30 through the opening 311 and latched by the latch means 32. Thus the handle assembly can be securely installed on the bottom of the roman shade 30 without dropping.

When the anchor member 50 is installed and used, it can be screwed to a screw hole (not shown in the drawings) on the bracing bar 64 at the bottom of the roman shade 60 corresponding to the ring 65. The control cord 621 can be threaded through the through hole 521 of the conical portion 52 and coupled with the bracing bar 64 at the bottom.

Figure 10:
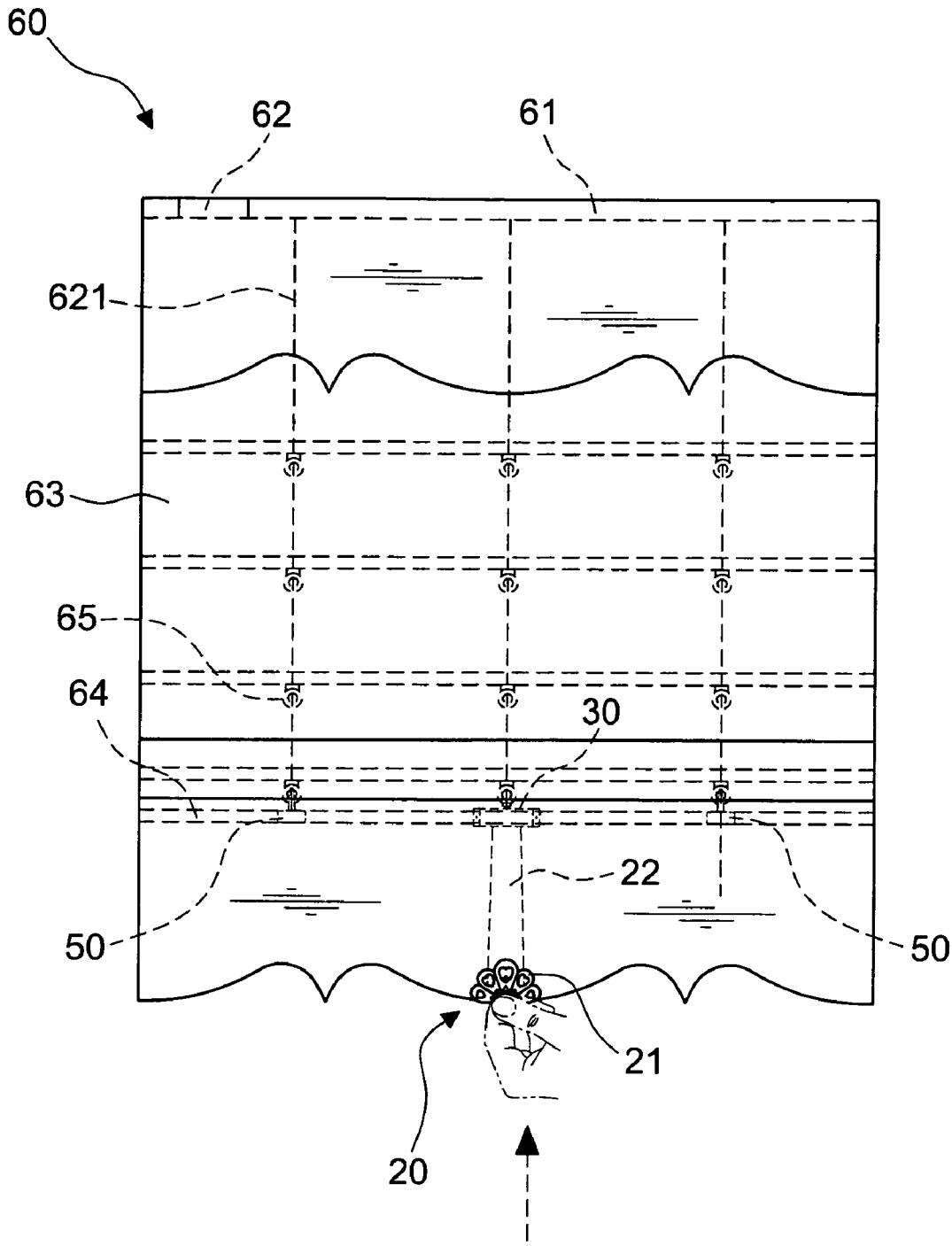
FIG. 10 is a schematic view of the present invention in a use condition.

When in use, referring to FIG. 10, for rolling or extending the roman shade 60, grasp the handle 20 and move upwards. The anchor plate 22, by coupling with the bracing bar 64 at the bottom of the roman shade 60, can move the fabric shade 63 upwards, then the automatic winder 62, incorporating with the control cord 621 and other elements, can automatically wind and retract the fabric shade 63 upwards. To extend the roman shade 60, pull the handle 20 downwards forcefully, the automatic winder 62 and the relative elements can extend the fabric shade downward. During rolling of the fabric shade 63, the conical portion 52 of the anchor member 50 provides a guiding function by threading through the ring 65 so that rolling of the fabric shade 63 can be accomplished smoothly.

In short, the handle assembly for cordless roman shades of the invention has the following features:

1. For rolling the roman shade 60, the handle 20 can receive forces. By coupling of the anchor plate 22 and the bracing bar 64 on the bottom of the roman shade 60, the fabric shade 63 can receive a lifting force and be moved upwards effectively. Hence control of the rolling operation is simpler.

2. The handle 20 can be installed on the bottom of the roman shade 60. The ornamental plate 21 provides an adorning function. Incorporating with the patterns on the surface of the fabric shade 63, the entire roman shade 60 has a greater aesthetic appealing and more added values.

Figure 11:
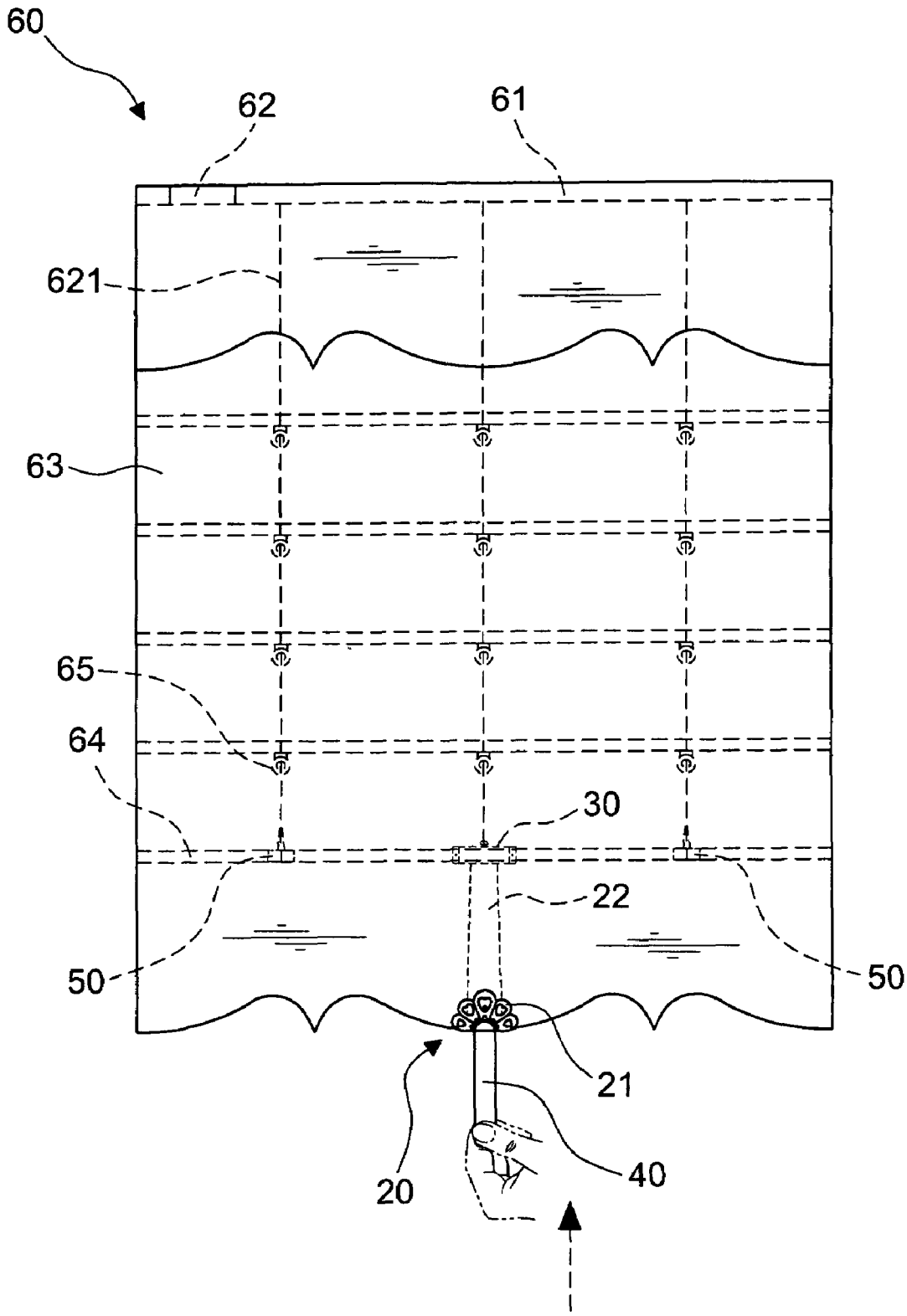
FIG. 11 is a schematic view of the present invention in another use condition.

3. As shown in FIGS. 7 and 11, when the fabric shade 63 is rolled to an elevation beyond the reach of users, the extension plate 40 can be swiveled about the pin 42 on the backside of the anchor plate 22. Thus users can grasp the extension plate 40 to perform rolling operation.

The handle assembly for the cordless roman shades of the invention can be used on a cordless roman shade 60 to facilitate rolling and extending operation. It also provides an excellent ornamental effect and can motivate purchase desire of consumers.

What is claimed is:

1. A handle assembly for roman shades, comprising at least:

an ornamental plate and an anchor plate that are coupled together at one portion while being spaced from each other at remaining portions to form a clipping space therebetween, the anchor plate having a fastening portion on a upper end;

an anchor device which has a hollow shell and a latch means, the shell having an opening to receive the fastening portion into the shell, the latch means being located in the shell to be coupled with the fastening portion of the handle; and an extension plate having a lower end pivotally coupled on lower end of backside of the anchor plate through a pin.

2. The handle assembly of claim 1, wherein the fastening portion has two corresponding notches on two side edges opposite to each other close to a upper end of the anchor plate, the shell having a hole on a upper end, the latch means including a pushbutton, two springs, a first latch strut and a second latch strut that are movably located in the shell, the pushbutton running through the hole and having one end located in the shell to form a thrust member, the first latch strut and the second latch strut being located on two sides of and contacting the thrust member and having respectively a latch end corresponding to the notches of the fastening portion, the two springs each having one end fixedly located in the shell and other end coupling with a middle portion of the first and the second latch struts.

3. The handle assembly of claim 1, wherein the handle assembly further includes a plurality of anchor members for engaging a bracing bar of the roman shade, each of the anchor members having an anchor plate portion which has at least one aperture, the anchor plate portion being extended to form a conical portion which has a through hole for receiving a control cord.

4. The handle assembly of claim 1, wherein the ornamental plate includes a plurality of floral petals arranged in a juxtaposed and radial manner.

5. The handle assembly of claim 1, wherein the anchor plate has a detent member on one side corresponding to the extension plate, the detent member has a slot on one side.

6. The handle assembly of claim 1, wherein the shell has at least one aperture for receiving a fastening element.

* * * * *